United States Patent [19]

Kawabe

[11] 4,343,270

[45] Aug. 10, 1982

[54] INTERNAL COMBUSTION ENGINE

[75] Inventor: Toshihiko Kawabe, Takatsuki, Japan

[73] Assignee: Yanmar Diesel Engine Co., Ltd., Osaka, Japan

[21] Appl. No.: 143,909

[22] Filed: Apr. 25, 1980

[30] Foreign Application Priority Data

Sep. 3, 1979 [JP] Japan ..... 54-121532[U]
Sep. 3, 1979 [JP] Japan ..... 54-121534[U]
Dec. 6, 1979 [JP] Japan ..... 54-168820[U]

[51] Int. Cl.[3] ..... F01M 1/00

[52] U.S. Cl. ..... 123/196 V; 123/90.34; 184/6.9

[58] Field of Search ..... 123/196 V, 90.34, 90.27; 184/6.5-6.6, 6.7, 6.8, 6.9

[56] References Cited

U.S. PATENT DOCUMENTS 2,354,926 8/1944 Patterson ..... 184/6.9
3,824,973 7/1974 Harhaus ..... 184/6.9
3,875,908 4/1975 Ayres ..... 123/90.34

*Primary Examiner*—Charles J. Myhre
*Assistant Examiner*—E. Rollins Cross
*Attorney, Agent, or Firm*—Armstrong, Nikaido, Marmelstein & Kubovcik

[57] ABSTRACT

An internal combustion engine having thereon a cylinder head, a valve mechanism consisting of a cam and a valve arm, comprising a rib-type oil received provided on that portion of the inner surface of a head cover which is in opposition to contact portions of the cam and the valve arm with an oil ejection bore provided in the valve arm directed to the rib-type oil receiver.

1 Claim, 12 Drawing Figures

INTERNAL COMBUSTION ENGINE

BACKGROUND OF THE INVENTION

1. Field of the Invention

The present invention relates to an overhead cam shaft type (which will be hereinafter referred to as OHC type) internal combustion engine which permits efficiently supplying a lubricating oil into a valve mechanism provided on a cylinder head, and smoothly returning the lubricating oil from the valve mechanism to a crank case.

2. Description of the Prior Art

There is a known OHC type internal combustion engine which permits returning a lubricating oil, with which a valve mechanism including a cam and a valve arm provided on a cylinder head has been lubricated, to a crank case provided under a cylinder block, without passing the oil through a tappet provided in the cylinder block.

Such a type of internal combustion engine is provided with lubricating oil returning bores in that portion of the engine which is spaced from partition walls in the crank case, i.e. in the vicinity of rotating parts, such as a crankshaft and a connecting rod. Accordingly, return oil contacting and scattering from a rotating part, such as a crankshaft or a connecting rod, sticks to a side wall of the crank case so that the amount of consumption of lubricating oil is increased.

When a lubricating oil returning bore is provided in a position spaced from the crank case wall, the bore is away from the position where a head bolt is screwed. As a result, the tightening force of the head bolt applied to the cylinder head attaching portion is reduced so that the oil leaks from a gasket packing interposed between the cylinder head and cylinder block.

A lubricating oil returning bore also serves to recycle a blow-by gas, which leaks from a cylinder into a crank case, into a sucked gas, and guide the blow-by gas into a cylinder guide provided with a breather from which the blow-by gas is discharged into the atmosphere.

Since a blow-by gas upwardly flowing through the lubricating oil returning bore crosses therein the lubricating oil downwardly flowing therethrough, the returning of lubricating oil cannot be carried out excellently, or the lubricating oil is blown out from the breather.

A conventional internal combustion engine of this kind generally does not permit sufficiently supplying a lubricating oil into a valve mechanism.

SUMMARY OF THE INVENTION

An object of the present invention is to sufficiently supply a lubricating oil into a valve mechanism provided on a cylinder head and smoothly return the lubricating oil from the valve mechanism to a crank case.

Another object of the present invention is to prevent leakage of oil from a gasket packing provided in a cylinder head attaching portion, and smoothly and securely return the oil from the cylinder head to the crank case without causing the oil to contacting a rotating part, such as a crankshaft.

Still another object of the present invention is to provide lubricating oil returning bores and a blow-by gas discharge bore in different positions.

A further object of the present invention is to provide in the vicinity of partition walls in a crank case lubricating oil returning bores which communicate a cylinder head with a crank case.

A further object of the present invention is to provide a blow-by gas discharged bore such that the upper circumferential end of the blow-by gas discharge bore is higher than that of the lubricating oil returning bore.

A further object of the present invention is to efficiently supply a lubricating oil into a sliding portion of a valve mechanism.

To these ends, the present invention provides an internal combustion engine having lubricating oil returning bores provided through a cylinder head and a cylinder block joined thereto, to allow a lubricating oil to be returned to a crank case, which is attached to the cylinder block, through the lubricating oil returning bores, characterized in that the lubricating oil returning bores are opened at one end each thereof in a position which is spaced as much as possible from rotating parts, such as a crankshaft disposed in the crank case or a connecting rod.

The above and other objects as well as advantageous features of the invention will become clear from the following description of the preferred embodiments in conjunction with the accompanying drawings.

DESCRIPTION OF THE PREFERRED EMBODIMENTS

Figure 1:
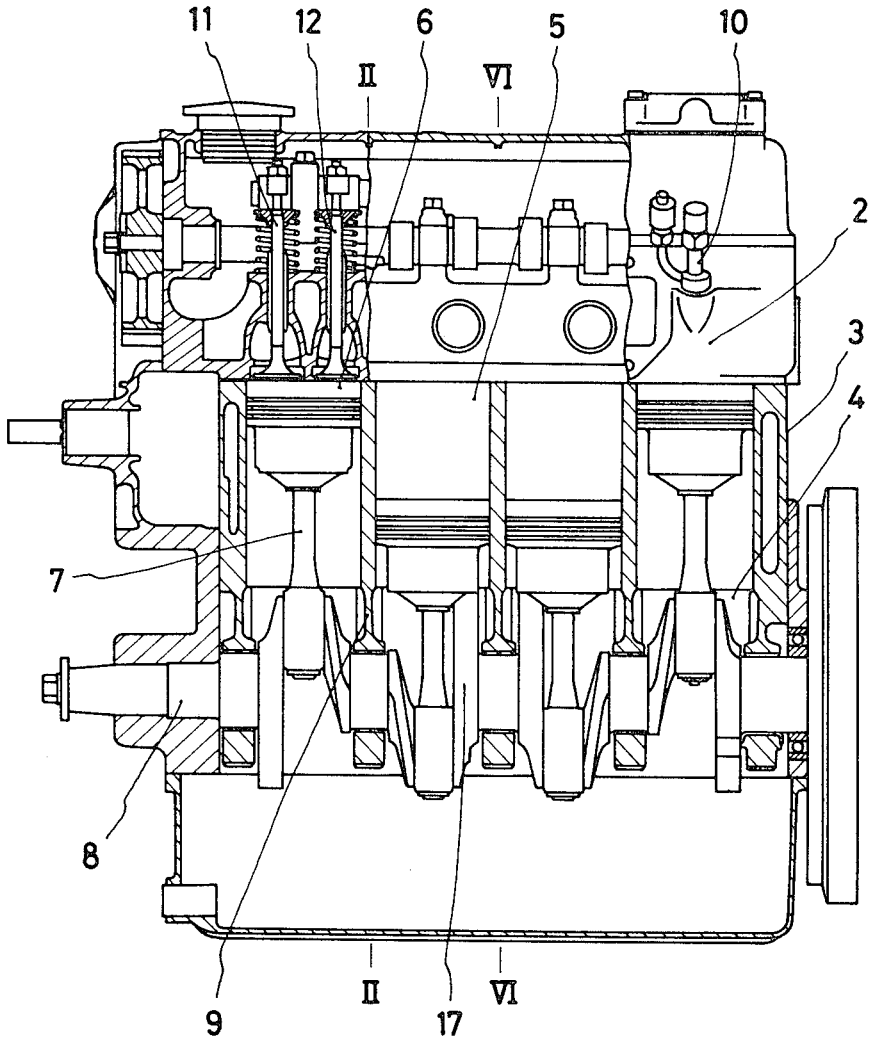
FIG. 1 is a sectional view partially in side elevation of an internal combustion engine embodying the present invention.

FIG. 1 shows an embodiment of an OHC type internal combustion engine according to the present invention, which has a cylinder head 2 set on a cylinder block 3 via a gasket packing 16 and provided with a valve mechanism 15 including a valve 10, an intake valve 11, an exhaust valve 12, a valve arm and a cam 14. A head cover 1 is attached to the upper end of the cylinder head 2.

A piston 6 slidingly movably provided in the cylinder 5 set on the cylinder block 3 is connected via a connecting rod 7 to a crankshaft 8 in a crank case. The crankshaft 8 is supported on bearings 17 provided in partition walls 9 in the crank case.

Figure 5:
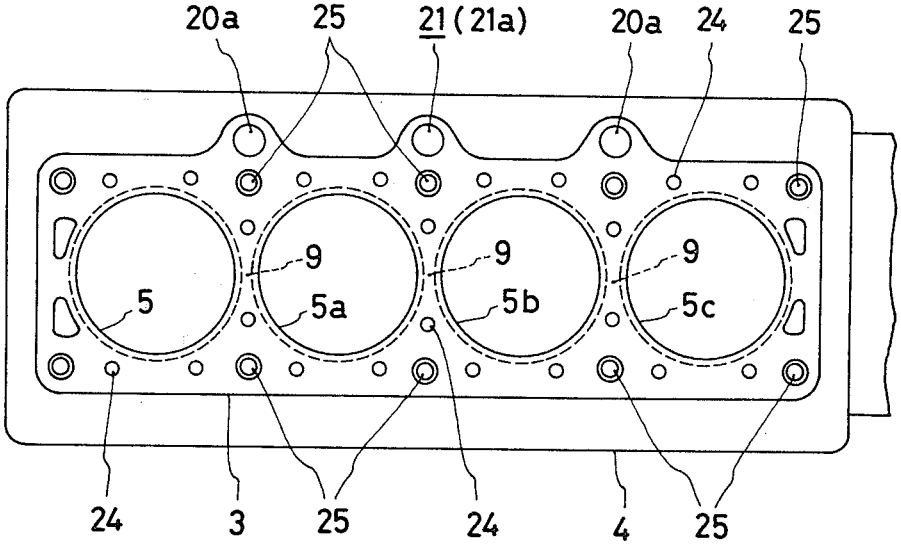
FIG. 5 is a plan view of a cylinder block in the engine shown in FIG. 1.

According to the present invention, lubricating oil returning bores 20 and blow-by gas discharge bores 21 are alternately provided in the cylinder block 3 as shown in FIG. 5.

The lubricating oil returning bores 20 will be described first.

Figure 2:
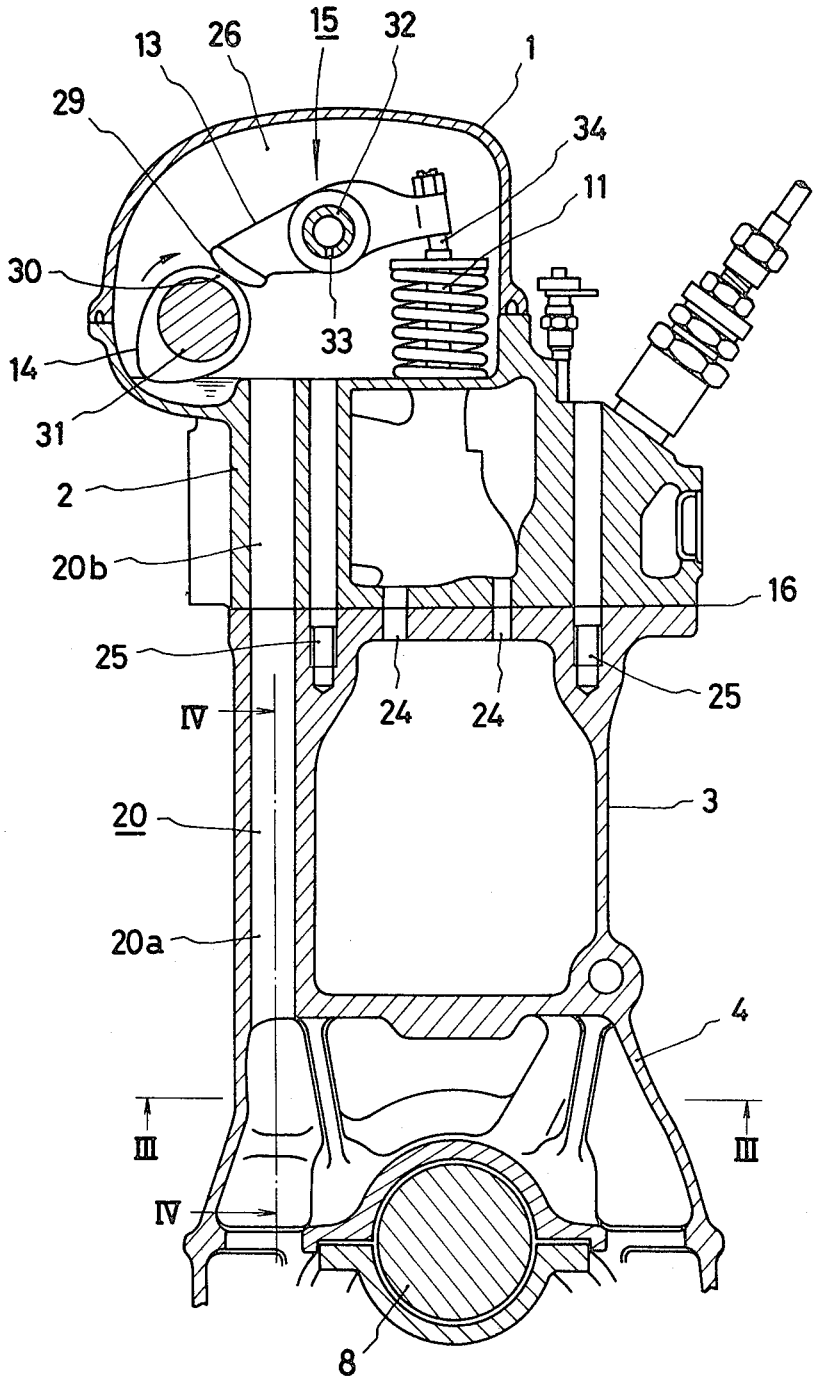
FIG. 2 is a sectional view taken along the line II—II in FIG. 1.

As may be understood from FIG. 2, each lubricating oil returning bore 20 consists of a portion 20*a* provided in the cylinder block 3 and a portion 20*b* communicated with the portion 20*a* and provided in the cylinder head 2.

Figure 3:
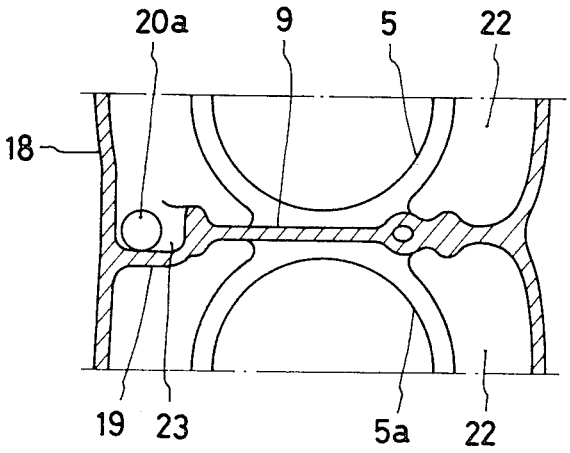
FIG. 3 is a sectional view taken along the line III—III in FIG. 2.
Figure 4:
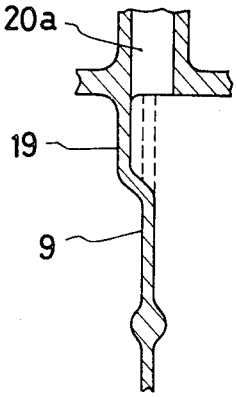
FIG. 4 is a sectional view taken along the line IV—IV in FIG. 2.

As may be understood from FIGS. 3–5, the portion 20*a* is formed by protruding a part of a partition wall 9 in the crank case, which is provided between adjacent cylinders 5, 5*a*, i.e. that part of the partition wall 9 which is close to one side wall 18 of the crank case 4, toward the cylinder 5*a* as indicated by reference numeral 19, to form a recess 23 continuing from a crank chamber 22 having the cylinder 5 therein; and making a bore perpendicularly from the upper surface of the cylinder block 3.

The lubricating oil returning bore 20 is formed by a machining work using a drill, or by drawing a mold during a casting operation.

A blow-by gas discharge bore 21 is formed in the same manner as the lubricating oil returning bore 20 in a partition wall 9 in the crank case, which is provided between the cylinders 5*a*, 5*b* as shown in FIG. 5. The blow-by gas discharge bore 21 is provided, on the upper end of a portion 21*b* in the cylinder head 2, with a pipe 27 secured thereto so that the upper end of the pipe 27 is higher than that of the lubricating oil returning bore 20. This allows the lubricating oil, which is collected in a valve arm chamber 26 formed by the head cover 1 and cylinder block 2, to be prevented from entering the blow-by gas discharge bore 21.

The blow-by gas discharge bore 21 consists of a portion 21*b* provided in the cylinder head 2 and a portion 21*a* provided in the cylinder block 3.

Figure 7:
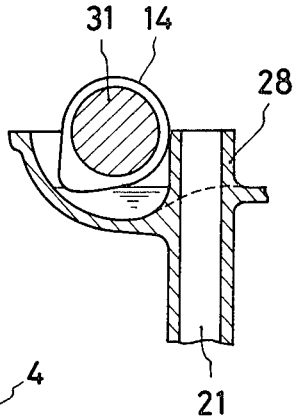
FIG. 7 is a sectional view of another example of a blow-by gas discharge bore provided in the engine shown in FIG. 1.

The blow-by gas discharge bore 21 may be integrally formed with a tubular projection 28 as shown in FIG. 7 while the cylinder head 2 is cast.

Another lubricating oil returning bore 20*a*, which is identical with the lubricating oil returning bore 20 provided in the partition wall 9 in the crank case between the cylinders 5, 5*a*, is formed in another partition wall 9 between the cylinders 5*b*, 5*c* as shown in FIG. 5.

In the above-described embodiment, the lubricating oil returning bores 20 and blow-by gas discharge bore 21 are provided alternately but the arrangement of these bores is not limited to the above. The bores 20, 21 may be provided close to one another.

Figure 6:
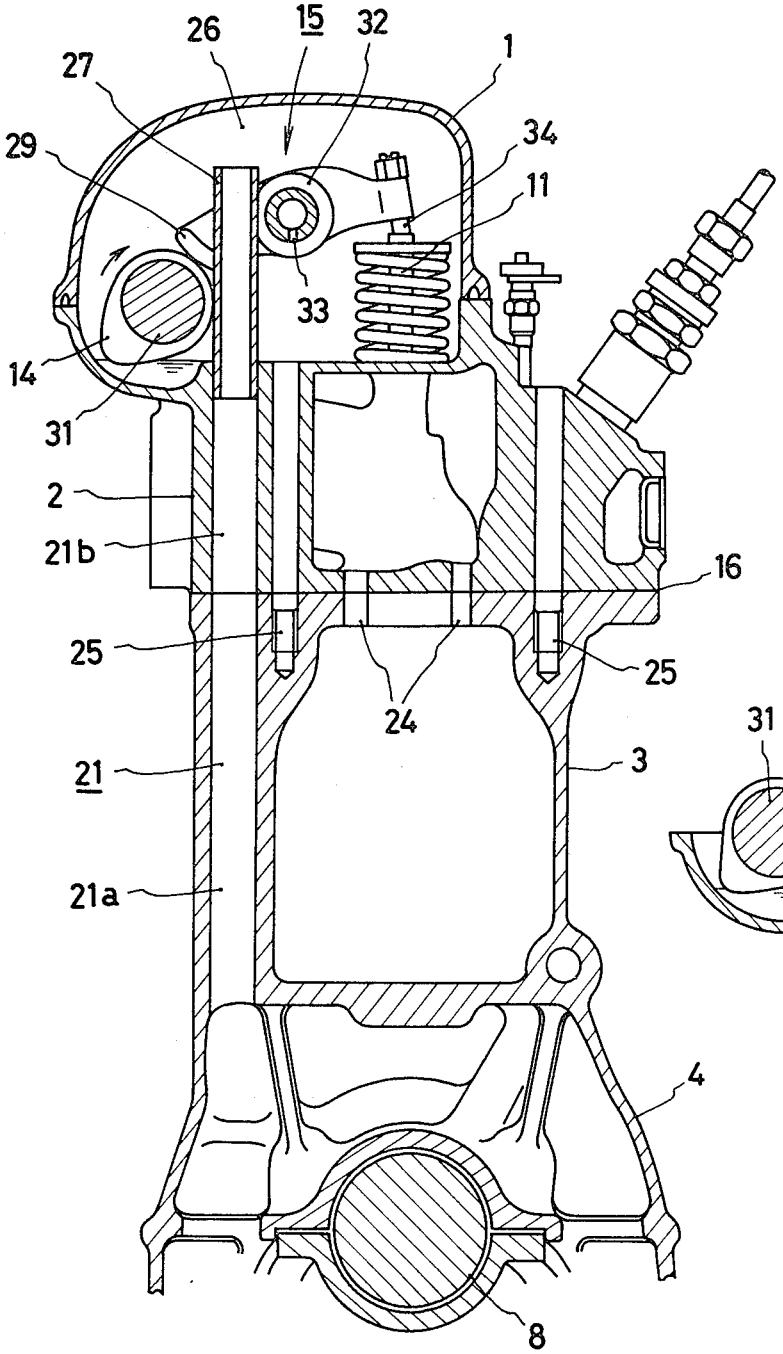
FIG. 6 is a sectional view taken along the line VI—VI in FIG. 1.

Bores 24 for cooling water are provided through walls of the cylinder head 2 and cylinder block 3 as shown in FIGS. 2 and 6. Bores 25 are also formed in the cylinder block 3, into which cylinder head tightening screws are driven. These bores 25 are provided in four corners of the cylinder block 3 with respect to the upper end surface thereof and in the opposite portions of each of the partition walls 9 in the crank case.

Accordingly, the bores 25 are also formed in the partition walls 9 in the crank case just as the lubricating oil returning bores 20. As a result, a great tightening force is applied to the vicinity of the lubricating oil returning bores 20 when the cylinder head 2 and cylinder block 3 are tightened so that the leakage of lubricating oil through the gap between the cylinder head 2 and cylinder block 3 can be prevented.

A lubricating oil is supplied to the valve mechanism 15 such a manner as follows.

The lubricating oil in the crank case 4 is supplied to a hollow valve arm shaft 32 as shown in FIG. 2 through a feed pipe (not shown). The valve arm shaft 32 is provided with a small bore 33 at that portion thereof on which a valve arm 13 is mounted.

The lubricating oil supplied through the small bore 33 into a gap between the valve arm 13 and valve arm shaft 32 to subject the contact surfaces thereof to lubrication flows therefrom downwardly into a valve arm chamber 26.

A cam 14 is integrally formed with a cam shaft 31 in opposition to a slide surface 29 provided at one end of the valve arm 13. When the cam 14 is rotated in the direction of an arrow, the lubricating oil collected in the valve chamber 26 is supplied the slide surface 29 of the valve arm and a contact portion 30 of the cam 14.

Reference numeral 34 denotes an adjusting bolt provided at the other end of the valve arm 13.

The lubrication of the valve arm 13 and contact portion 30 of the cam 14 may be carried out more sufficiently by providing the following.

Figure 8:
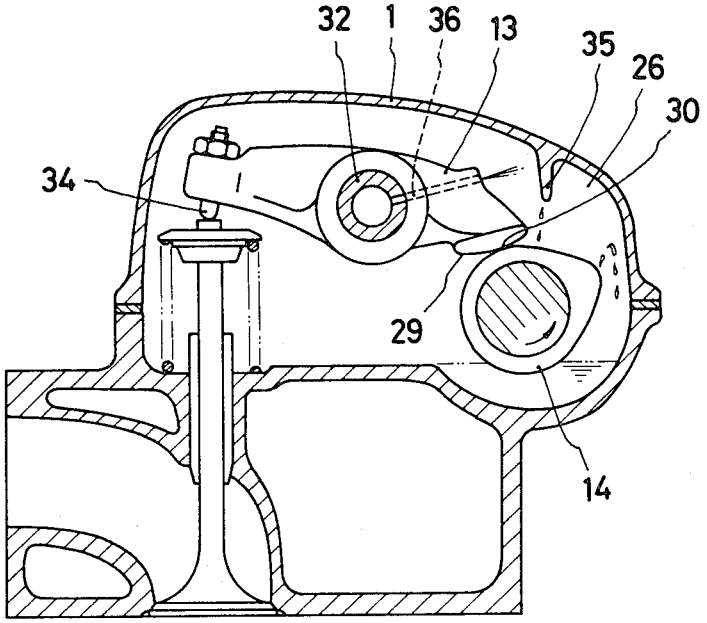
FIG. 8 is a sectional view illustrating a stage of supplying a lubricating oil to a sliding portion of a valve mechanism.

A rib type oil receiver 35 is integrally formed with a head cover 1 at that portion of the inner surface thereof which is above the slide surface 29 of the valve arm and the contact portion 30 of the cam 14 as shown in FIG. 8. An ejection bore 36 communicated with the hollow valve arm shaft 32 is provided in the valve arm 13, which ejection bore 36 is opened in opposition to the oil receiver 35.

The lubricating oil supplied under pressure from the valve shaft arm 32 is ejected from the ejection bore 36 against the oil receiver 35. The lubricating oil impinging upon the oil receiver 35 then drops onto that portion of the cam surface which is to come into contact with the slide surface 29 of the valve arm 13 so that the slide surface 29 of the valve arm 13 and the contact surface 30 of the cam 14 can be sufficiently lubricated.

The rib type oil receiver 35 may be formed independently of the head cover 1 so as to be detachably joined thereto.

When the cam 14 is rotated clockwise, i.e. in a direction opposite to the direction of arrow, the ejection bore 36 may be provided such that, for example, the ejection bore 36 is opened in a position slightly on the left side of the contact point of the slide surface 29 of the valve arm 13 and the contact surface 30 of the cam 14.

The lubrication of the contact surface 30 of the cam 14 and the slide surface 29 of the valve arm 13 may also be carried out sufficiently by the following structure.

A branch passage 38 communicated with a main passage 37 for lubricating oil provided in the cylinder head 2 is formed such as to be extended to the lower surface of the head cover 1 and such as to allow an ejection end 39 to be opened toward the contact surface of the cam 14 and the slide surface 29 of the valve arm 13. Thus, the lubricating oil can be ejected from the ejection end 39 toward the contact surface of the cam 14 and the slide surface 29 of the valve arm 13.

The lubrication of the above-mentioned surfaces can be carried out sufficiently by the following structure as well.

Figure 10:
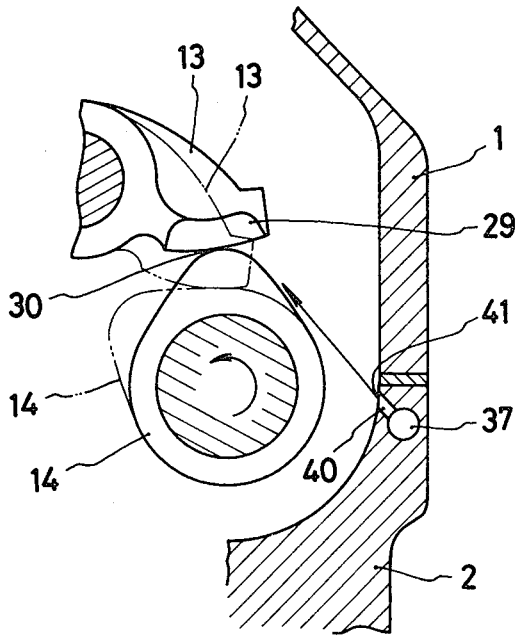
FIG. 10 is a sectional view illustrating still another stage of supplying a lubricating oil to a sliding portion of the valve mechanism.

A branch passage 40 communicated with the main passage 37 provided in the cylinder head 2 is formed such that the branch passage 40 is inclined toward the contact surface 30 of the cam 14 and the slide surface 29 of the valve arm 13 as shown in FIG. 10. The lubricating oil is ejected toward the above-mentioned surfaces 30, 29 from an ejection end 41 of the branch passage 40.

Figure 9:
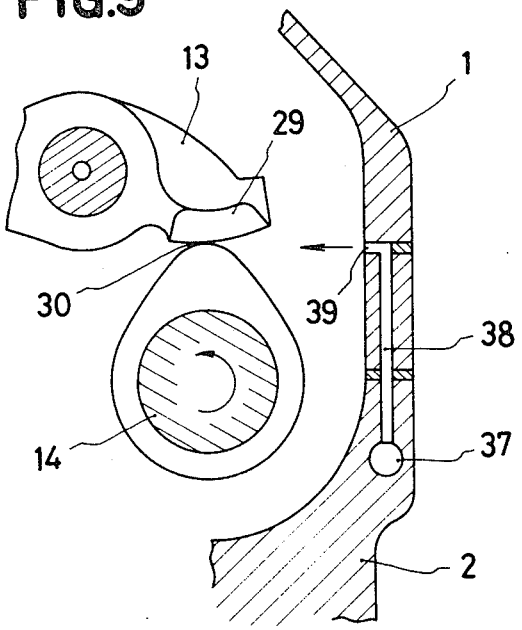
FIG. 9 is a sectional view illustrating another stage of supplying a lubricating oil to a sliding portion of the valve mechanism.

In the embodiments shown in FIGS. 9 and 10, it is unnecessary that a rib type oil receiver 35 as shown in FIG. 8 be provided on the inner surface of the head cover 1. Therefore, the head cover 1 in these embodiments can be produced simply, and the scattering of lubricating oil from the oil receiver 35 can be prevented. Thus, the lubricating oil can be supplied sufficiently to the contact surface 30 of the cam 14 and the slide surface 29 of the valve arm 13.

A metal receiver 42 set on the upper end of an intake valve 11 and exhaust valve 12 is provided with a recess 43 in that surface thereof which is contacted by a gap adjusting bolt 34 provided in the valve arm 13. The recess 43 is filled with a lubricating oil to prevent the metal receiver 42 from being worn.

Figure 11:
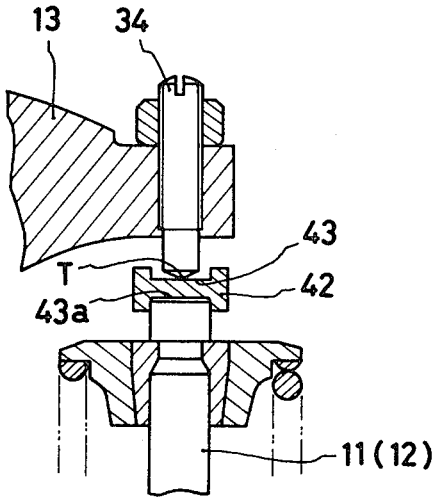
FIG. 11 is a longitudinal sectional view of contact portions of a valve arm and a valve.
Figure 12:
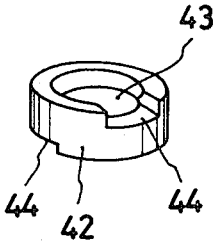
FIG. 12 is a perspective view of a metal receiver shown in FIG. 11.

A recess 43*a*, the diameter of which is equal to that of the recess 43 provided in the upper surface of the metal receiver 42, is provided in the lower surface thereof as shown in FIGS. 11 and 12.

When the recess 43 is worn during an operation of the internal combustion engine to become unserviceable, the metal receiver 42 is inverted to be continuously used. This allows the life of the metal receiver 42 to be doubled.

In order to easily insert a gap gauge (not shown) into a gap T between the lower end portion of a valve gap adjusting bolt 34 and the contact surface of the metal receiver 42 when adjusting the gap T, a slide 44 formed in a portion of the metal receiver as shown in FIGS. 11 and 12 can be conveniently used.

The operation of an internal combustion engine according to the present invention will be described.

The blow-by gas leaking from the cylinders 5, 5*a*, 5*b*, 5*c* into the crank case 4 flows into the valve arm chamber 26 via the blow-by gas discharge bore 21 so as to be discharged into the atmosphere from a breather (not shown) provided on the valve arm chamber 26.

The lubricating oil, with which the contact surface 30 of the cam 14 and the slide surface 29 of the valve arm 13 is lubricated, flows through the lubricating oil returning bores 20*a* and 20 opened in a lower position than the blow-by gas discharge bore 21, to be returned to the crank case 4 from recesses defined by the protruded portions 19 of the partition walls 9 in the crank case 4, without contacting the connecting rod 7 or the crankshaft 8.

Since the lubricating oil, with which the valve mechanism in the valve arm chamber in an internal combustion engine according to the present invention has been lubricated, is returned to the crank case through bores provided in the partition walls provided therein, the lubricating oil never comes into contact with rotating parts, such as crankshaft and connecting rod to be scattered against the crank case walls. Namely, the lubricating oil is smoothly returned to the crank case. This allows the consumption amount of lubricating oil and power loss to be reduced, and prevents the valve mechanism from being deteriorated.

Since the lubricating oil returning bores are provided close to the cylinder head tightening head bolt, the leakage of lubricating oil from the gasket packing rarely occurs. This allows the construction of the gasket packing to be simplified so that the gasket packing can be manufactured at a low cost.

Since the greater part of the blow-by gas upwardly flows through the blow-by gas discharge bore, the lubricating oil is returned through the lubricating returning bore to the crank case excellently, and the lubricating oil is never blow out from the breather.

The present invention is not, of course, limited to the above-described embodiments; it may be modified in various ways within the scope of the appended claims.

What is claimed is:

1. An internal combustion engine having on a cylinder head a valve mechanism consisting of a cam and a valve arm, comprising a rib type oil receiver provided on that portion of the inner surface of a head cover which is in opposition to contact portions of said cam and said valve arm, and an oil ejection bore provided in said valve arm and directed to said rib type oil receiver.

* * * * *